United States Patent [19]

Stoddard et al.

[11] 4,058,164

[45] Nov. 15, 1977

[54] HEATING MINE WATER FOR RECOVERY OF IMMOBILE HYDROCARBONS

[76] Inventors: Xerxes T. Stoddard, 2617 W. 27th Ave., Denver, Colo. 80212; Ruel C. Terry, 3090 S. High St., Denver, Colo. 80210

[21] Appl. No.: 676,001

[22] Filed: Apr. 12, 1976

[51] Int. Cl.[2] ..... E21B 43/24

[52] U.S. Cl. ..... 166/303

[58] Field of Search ..... 166/303, 272, 302

[56] References Cited

U.S. PATENT DOCUMENTS

| | | | |
|---|---|---|---|
| 3,167,120 | 1/1965 | Pryor | 166/272 X |
| 3,186,484 | 6/1965 | Waterman | 166/272 X |
| 3,396,791 | 8/1968 | Van Meurs et al. | 166/272 |
| 3,405,761 | 10/1968 | Parker | 166/272 X |
| 3,881,551 | 5/1975 | Terry et al. | 166/272 |
| 3,913,671 | 10/1975 | Redford et al. | 166/272 X |

*Primary Examiner*—Stephen J. Novosad

*Attorney, Agent, or Firm*—Ruel C. Terry

[57] ABSTRACT

This invention relates to the use of superheated water as a heat carrier to melt or reduce the viscosity of a solid or semi-liquid hydrocarbon located in an underground deposit. Steam is injected in one conduit and water is injected in a second conduit. Steam is condensed and mixed with the injected water in an underground mixing chamber under sufficient pressure to maintain the resultant superheated water in the liquid phase.

6 Claims, 1 Drawing Figure

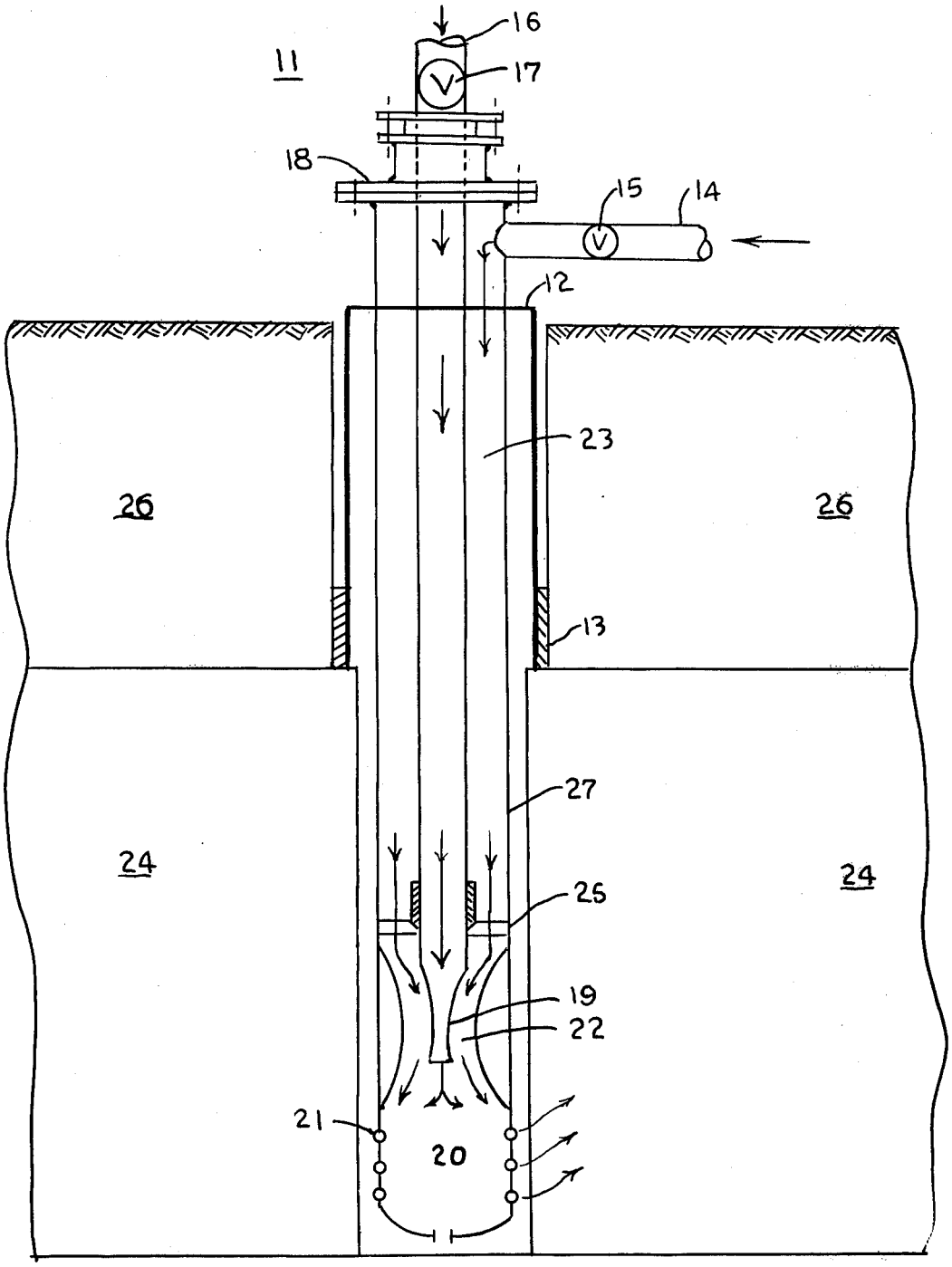
FIG-1
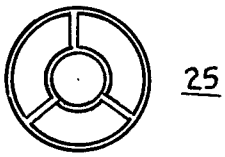

HEATING MINE WATER FOR RECOVERY OF IMMOBILE HYDROCARBONS

BACKGROUND OF THE INVENTION

There are many mineral extraction processes that use hot water in an underground location. One is described in U.S. Pat. No. 3,881,551 of the present inventors. Others include the thermal floods of the petroleum industry. Ofter it is preferred to use superheated water that is well above the boiling temperature at atmospheric pressure but is kept from flashing to vapor by keeping the water under appropriate pressure. Steam is capable of delivering more units of heat on a weight basis than superheated water, but superheated water generally is capable of delivering more units of heat on a volume basis than steam.

Water requires one BTU of heat per pound for each degree Farenheit of temperature increase. In converting water from liquid to vapor, additional heat approximating 1000 BTU per pound is required, with a corresponding liberation of heat when the vapor is condensed back to liquid.

For the most part superheated water or steam are utilized underground as a carrier of heat values for transfer to a cooler substance such as gilsonite, bitumen in tar sands, viscous heavy petroleum crudes that are immobile and the like. Generally the purpose is to melt substances such as gilsonite or to reduce the viscosity of substances such as bitumen or heavy oils. For the heat carrier fluid to be effective it must be dispersed in a manner that will minimize heat losses both above ground and underground. In the ideal case all of the heat to be transferred would pass from the heat carrier fluid to the substance to be made flowable. The heat carrier fluid must have enough available heat for transfer to the substance to accomplish the purpose intended; that is, to cause the substance to become a flowable liquid so that it can be made to migrate under the influence of gravity and differential pressure.

It is quite common in underground mineralized formations to find channels that permit free flow of fluids compared to adjacent portions of the deposit which may have relatively low values of permeability. Steam performs poorly in the open channels underground because it tends to expand, condense to liquid and liberate heat that results in localized hot spots. Superheated water on the other hand readily follows the open channels. In a commercial project it is desirable that the heat carrier fluid transfer heat as uniformly as possible to the underground deposit. Therefore superheated water is the preferred heat carrier fluid when heat content per unit volume is important and when it is expected that underground channels will be encountered.

In the prior art it is common to find water kept under sufficient pressure to prevent bubbling or flashing to vapor, with heat added by numerous transfer means in above ground facilities. The water is thus superheated to an appropriate temperature for example 360° F so that after allowing for heat losses between the above ground heater and the underground deposit, the water will retain enough heat to accomplish its purpose underground.

It is an object of the present invention to disclose new methods in the use of steam in combination with water to form superheated water in an underground location. Other objects, advantages and capabilities of the present invention will become more apparent as the description proceeds and in conjuction with the accompanying drawing.

BRIEF DESCRIPTION OF THE DRAWING

FIG. 1 is a diagrammatic vertical section taken through a portion of the earth showing a well drilled from the surface of the ground to an underground mineral deposit wherein it is desired to inject a heat carrier fluid.

SUMMARY OF THE INVENTION

A well 11 is drilled from the surface of the ground to an underground mineral deposit. The well could be for example nine inches in diameter and the mineral deposit to be produced 24 could be for example 200 feet below the surface. A casing 12 for example 13 ⅜ inches in diameter with appropriate wellhead connections (not shown) is set and cemented 13 into place using sufficient cement to provide a hermetic seal between the underground deposit 24 and the surface of the earth. In the overburden 26 the well is then deepened by drilling into the underground deposit to a point for example at or near its lowermost mineralization. At the surface, liner 27 has connected to it flow line 14 containing valve 15. Within liner 27 is tubing 16 with a diameter for example of four inches which is suspended by wellhead 18. Above the wellhead, tubing 16 contains valve 17 and at its lowermost end tubing 16 contains nozzle 19. Also attached to the lower end of liner 27 is mixing chamber 20 containing perforations 21 and venturi 22. Nozzle 19 and venturi 22 are held in a fixed position by support ring 25 which has appropriate openings for the flow of water.

In this mode fluids may be made to flow through tubing 16, flow line 14, annulus 23, nozzle 19, perforations 21, chamber 20 and venturi 22 and into underground deposit 24. By injecting steam through tubing 16 and water through annulus 23, a resulting superheated water can be attained in the lower part of well 11.

DESCRIPTION OF THE PREFERRED EMBODIMENT

The process begins by opening valve 15 and injecting water at ambient temperature until annulus 23 is substantially full of water. Water injection is terminated with valve 15 remaining open. The process continues by opening valve 17 and injecting steam at a temperature for example of 500° F and a pressure of 600 psi at a rate of for example 330 lb/minute. Valve 15 remains open until the backflow of water through flow line 14 is substantially purged of trapped air, then water injection is begun through flow line 14 at a pressure for example of 175 psi into annulus 23. The rate of water injection into annulus 23 can be regulated by valve 15 to yield the desired temperature in mixing chamber 20, for example 330° F, when the system reaches a stabilized temperature.

It is preferred that the steam by injected at a standard temperature, pressure and rate as described above with the blended temperature stabilization attained by the water injection rate. Temperature stabilization also can be accomplished by keeping the annulus 23 substantially full of water and adjusting the rate of injection of steam.

In discharging the steam through nozzle 19, the nozzle design is governed by the planned pressure drop in the steam to liberate heat upon condensation at a rate that can be fully absorbed by the cooler water entering mixing chamber 20 through annulus 23. Preferably the water entering annulus 23 is properly treated so that scale will not form in mixing chamber 20.

The superheated water, for example at 330° F, exits into the bore of well 11 under sufficient pressure for example 275 psi to disperse through underground deposit 24, raising the temperature of mineralized deposit 24 and its entrapped minerals to the extent that the minerals become flowable and are withdrawn through a removal passage (not shown).

Thus it may be seen that a superheated water can be blended nearer its intended use underground than has been possible in the prior art. Heat losses are substantially minimized compared to the prior art resulting in a more efficient use of heat.

While the present invention has been described with a certain degree of particularity, it is understood that the present disclosure has been made by way of example and that changes in detail of structure may be made without departing from the spirit thereof.

What is claimed is:

1. A method of blending steam and water underground to generate superheated water in thermal recovery of minerals that are capable of becoming flowable upon application of heat, comprising the steps of establishing a first injection passage between a surface location and an underground mineral deposit, establishing a second injection passage between a surface location and an underground mineral deposit, affixing a nozzle means positioned at the lowermost portion of the said first injection passage, the said nozzle means being positioned within a venturi means, affixing the said venturi means positioned at the lowermost portion of the said second injection passage, establishing a mixing chamber means in an underground location, said mixing chamber means being in fluid communication with the said first injection passage and the said second injection passage, injecting steam into the said first injection passage, injecting water into the said second injection passage, decreasing the pressure of the steam, condensing the steam into a liquid while mixing the condensed steam with water in the said mixing chamber means, and directing the resultant superheated water from the said mixing chamber means into the mineralized formation underground.

2. The method of claim 1 wherein the steam temperature exceeds 250° F.

3. The method of claim 1 wherein the water temperature is less than 200° F.

4. The method of claim 1 wherein the mineral is gilsonite.

5. The method of claim 1 wherein the mineral is the bitumen in tar sands, sandstones and limestones.

6. The method of claim 1 wherein the mineral is viscous heavy petroleum.

* * * * *